United States Patent [19]

Shimamura

[11] 4,290,227

[45] Sep. 22, 1981

[54] TORQUE TRANSMISSION SYSTEM FOR MOTOR DRIVEN TOY

[75] Inventor: Juky Shimamura, Chigasaki, Japan

[73] Assignee: Asahi Communications Inc., Soka, Japan

[21] Appl. No.: 182,190

[22] Filed: Aug. 28, 1980

[30] Foreign Application Priority Data

Mar. 4, 1980 [JP] Japan ..... 55-26156

[51] Int. Cl.[3] ..... A63H 17/00

[52] U.S. Cl. ..... 46/206; 46/251; 46/212; 74/337

[58] Field of Search ..... 46/206, 201, 212, 251, 46/252, 253, 254, 255, 256, 257; 74/337

[56] References Cited

U.S. PATENT DOCUMENTS

| | | | |
|---|---|---|---|
| 1,054,346 | 2/1913 | Hall | 74/337 X |
| 1,780,858 | 11/1930 | Bearens | 74/337 X |
| 1,810,450 | 6/1931 | Von Broembsen | 74/337 |
| 1,979,080 | 10/1934 | Roeder | 74/337 |
| 3,475,854 | 11/1969 | Ryan et al. | 46/206 |
| 3,540,152 | 11/1970 | Beny et al. | 46/206 |

*Primary Examiner*—Gene Mancene
*Assistant Examiner*—Mickey Yu
*Attorney, Agent, or Firm*—Sughrue, Mion, Zinn, Macpeak and Seas

[57] ABSTRACT

A motor driven toy including a transmission mechanism having two output gears each engageable directly with a high speed transmission gear and a low speed transmission gear. One of the output gears is engaged with the high-speed transmission gear for the high-speed low-torque operation, whereas the other output gear is engaged with the low-speed transmission gear for low-speed high-torque operation. The change-over therebetween is well conducted by a tire load transmission cam having a synchronizing gear and a clutch mechanism provided between the synchronizing gear and the other output gear.

7 Claims, 8 Drawing Figures

TORQUE TRANSMISSION SYSTEM FOR MOTOR DRIVEN TOY

BACKGROUND OF THE INVENTION

The present invention relates to a toy driven by a small capacity motor. More particularly, the invention relates to an automatic variable torque transmission device for model cars or vehicles.

There have been previously proposed numerous types of transmission mechanisms for motor driven toys. However, there has been a strong demand for miniaturization and simplification of the transmission mechanism due to the fact that the motor used in such toys has a small capacity.

One type of such a transmission for motor driven toys is disclosed in U.S. Pat. No. 3,540,152. The transmission mechanism disclosed in that patent is relatively simple and may be miniaturized. However, the transmission has inherent defects due to its transmission clutch construction. That is, at a high speed and low torque, it is impossible to obtain smooth rotational power transmission and, at a low speed and high torque, the rotational torque must be transmitted to the output shaft through a clutch. Also, since the transmission clutch must be of a one-way type, it is impossible to reverse the vehicle using a motor generated torque.

More specifically, the transmission mechanism described in the reference patent will be explained with reference to FIGS. 1 to 3. FIG. 1 is a partial cross-sectional plan view showing a primary part of the mechanism in a normal high-speed low torque state and FIG. 2 is a similar plan view showing a low speed high-torque state thereof. A small capacity motor, torque reducing means, frame body and other associated parts are omitted in the drawings. In FIG. 1, reference numeral 10 denotes a gear engaged with an output gear of a torque reduction mechanism (not shown). A high speed gear 12 having a large diameter and a slow speed pinion 14 having a small diameter are mounted to always rotated with the gear 10 on a shaft indicated by a dotted line 16. During gear rotation, the gears 10, 12 and 14 are not displaced in the axial direction. On an output shaft 18 is fixedly disposed driven means such as a pair of tires 20, a stopper sleeve 22 and a cam sleeve element 24. An associated cam sleeve portion 26 is engaged with the fixed cam sleeve element 24 through slant cam surfaces 25 and 27. The portion 26 is formed integrally with an output gear 28 which engages with the high speed gear 12 in the high speed state shown in FIG. 1 and which is slidable in the axial direction. A high load gear 30 is mounted to freely rotate on the shaft 18 and is always engaged with the slow speed pinion 14 and biased toward the output gear 28 by a spring 36. A clutch, generally denoted by reference numeral 38, is of one-way type.

FIG. 3 is a perspective view illustrating the contruction of the clutch mechanism 38. The high load gear 30 has on its inner side a pair of projections 40 each of which includes an abrupt surface 32 and a gradually rising surface 34 as shown in FIG. 3. The output gear 28 is also provided with a pair of oppositely arranged similar projections 42 each engageable with the projections 40 of the high load gear 30. The one-way riding-over clutch 38 is thus constructed.

The transmission device operates as follows. For normal high speed operation, the output gear 28 and cam sleeve portion 26 are rotated in the direction indicated by the arrow 44 by a high speed gear 12 with torque being transmitted from the motor through the reduction gears and gear 10. At this time, the output gear 28 and the cam sleeve 26 tend to move axially leftward due to the provision of the cam engagement but the spring 36 serves to balance or engage the cam sleeve 28 and the fixed cam sleeve 24 through the clutch 38. Thus, while maintaining meshed engagement between the high speed gear 12 and the output gear 28, the rotational torque is transmitted to the tires 20. However, it should be noted that during normal high-speed low-torque operation of this transmission system, there is a difference in circumferential speeds between the high speed gear 12 and the slow speed pinion 14. The low speed pinion 14 is always engaged with the high gear 30 which is freely rotatable around the output shaft 18. The circumferential speed difference is absorbed by the one-way clutch 38 where the projections formed in the inner surface of the output gear 28 ride over the associated projections 40 formed in the high-load slow gear 30 which results in poor durability and rotational speed fluctuations.

Moreover, a vehicle provided with such a transmission device cannot be operated in reverse. That is, since the output gear 28 having the smaller number of gear teeth and the high torque gear 30 having the greater number of gear teeth, which are both provided on the same shaft 18, are rotated according to the outputted torque transmitted by the two gears 12 and 14 having different number of gear tooth and with the gears 12 and 14 provided on the same shaft 16, only one-directional rotation of the output shaft 18 is possible using the riding-over action of the one-way clutch 38. In a vehicle provided with such transmission system, if the reverse rotational torque were to be transmitted to the gears 12 and 14, the motor would stall because the one-way clutch projections 40 and 42 are engaged with each other.

For low-speed high torque operation, the transmission system operates as follows. When the vehicle runs on a steep grade or with a high load otherwise put on the tires, the cam sleeve 26 and the output gear 28 are pushed toward the left against the force of the spring 36 so that the output gear 28 disengages from the high speed gear 12. Then, the high load gear 30 is pushed leftward through the clutch 38 until its end abuts the stop 22. The gear 30 is thus engaged only with the slow speed gear 14 as shown in FIG. 2. The torque transmitted to the high load gear 30 is remarkably increased and the increased torque is further transmitted to the output shaft 28 through the clutch in which the projections 40 and 42 are fixedly engaged by the lateral component of force generated due to the tire load. Thus, the torque must be transmitted to the output shaft 18 through a somewhat intricate clutch construction during high load operation. This is an inherent defect to the prior art device.

SUMMARY OF THE INVENTION

In order to overcome the above-noted defects inherent to the prior art device, an object of the present invention is to provide a novel motor driven toy transmission system which is simple in construction and which has a high performance.

This, as well as other objects, are achieved by providing in a motor driven toy a transmission system including motor means, a rotary output shaft, driven means fixed on the rotary output shaft, a first rotary driving member drivingly connected to the motor means having a first diameter and rotated at a predetermined position, a second rotary driving member having a second diameter smaller than the first diameter, a first output member axially slidable on the first and second driving rotary members at the same rotational rate, a first output member axially slidable on the output shaft and drivingly engageable exclusively with the first driving member, a second output member axially slidable on the output shaft together with the first output member and rotated with the first output shaft and drivingly engageable exclusively with the second driving member, a first cam member axially slidable on the output shaft and rotated with the first output member including at least one first slant cam surface, a second cam member fixed on the output shaft including at least one first slant cam surface in contact with the first cam surface of the first cam member, a synchronizing rotary member axially slidable on the output shaft for synchronizing the second output member with the second rotary driving member during change-over from high-speed low-torque operation to the low-speed high-torque operation with the synchronizing rotary member being biased toward the first and second output members, and two-way clutch means provided between the synchronizing rotary member and the second output member.

In another embodiment of the present invention, the motor driven toy can be advanced and reversed with dual cam members.

DESCRIPTION OF THE PREFERRED EMBODIMENTS

Figure 1:
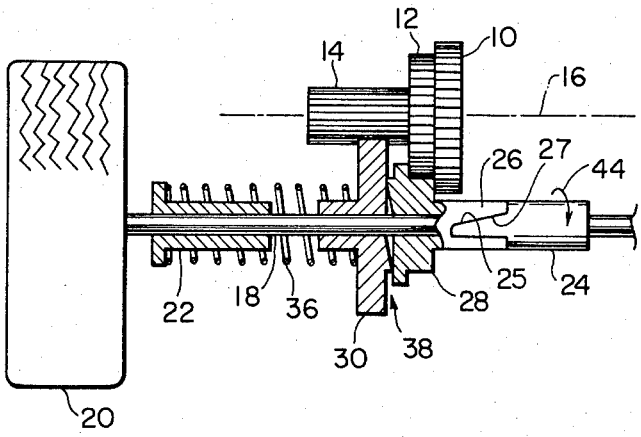
FIG. 1 PRIOR ART
FIG. 1 is a partial cross-sectional plan view showing a transmission mechanism of the motor driven toy according to the prior art in a state of normal high-speed low-torque operation.
Figure 2:
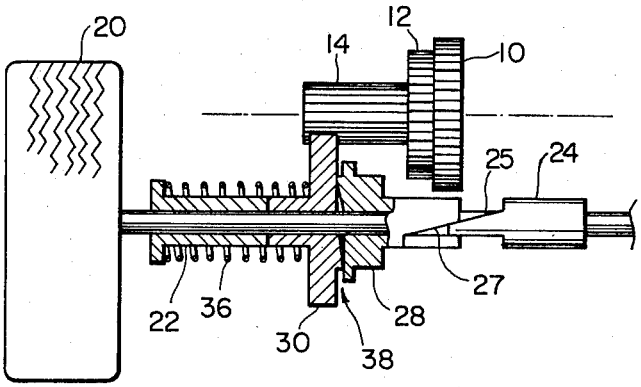
FIG. 2 PRIOR ART
FIG. 2 is a similar plan view showing the transmission mechanism shown in FIG. 1 in a state of low-speed high-torque operation.
Figure 3:
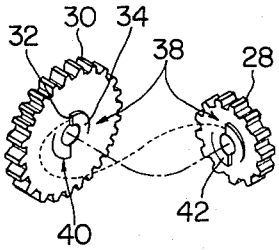
FIG. 3 PRIOR ART
FIG. 3 is a perspective view showing the clutch mechanism used in the transmission mechanism shown in FIGS. 1 and 2.
Figure 4:
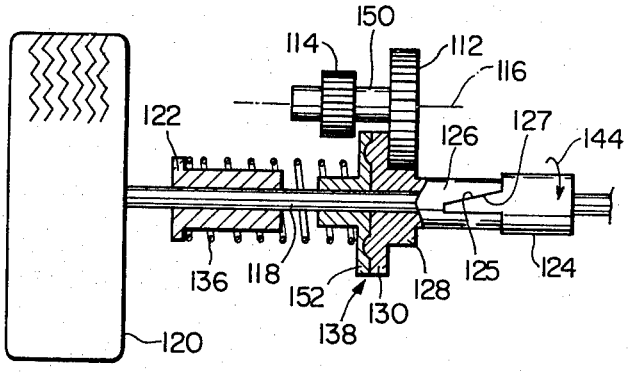
FIG. 4 is a partial cross-sectional plan view showing a transmission mechanism of the motor driven toy according to the present invention in a state of normal high-speed low-torque operation.
Figure 5:
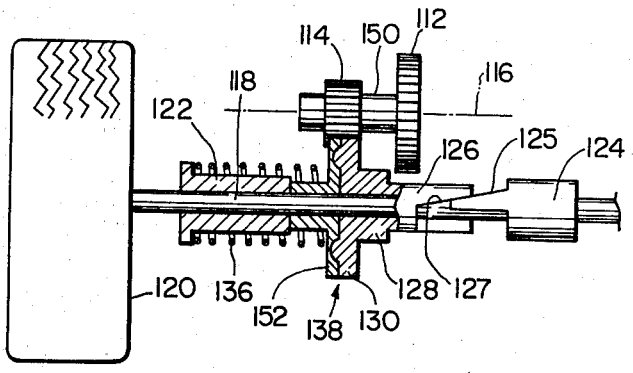
FIG. 5 is a similar plan view showing the transmission mechanism of FIG. 4 in a state of low-speed high-torque operation.

A first embodiment of a tranmission mechanism for a motor driven toy according to the present invention will now be described with reference to FIGS. 1 to 7. A high speed transmission gear 112 and a slow gear 114 are fixedly mounted on a common sleeve 150. The gear 112 has a greater diameter than that of the slow gear or pinion 114. The common sleeve 150 is freely rotatable around a shaft 116 indicated by a dotted line. In the same manner as in the prior art transmission described above, the high speed gear 112 is engaged with reduction gears (not shown) and is driven by motor torque so that the gear 112 is rotated together with the slow speed gear 114. On an output shaft 118 are fixedly mounted driven means such as a pair of tires, a stop 122 and a cam sleeve element 124. An associated cam sleeve portion 126 is integrally formed with an output gear 128 which is engaged with the above-described high speed gear 112. The output gear 128 is integrally formed with a high torque gear 130. The high torque gear 130 is provided with four round projections 154 as best shown in FIG. 7.

Figure 6:
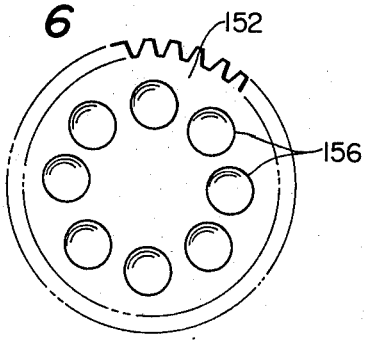
FIG. 6 is a side view showing round recesses included in the clutch mechanism of FIGS. 4 and 5.
Figure 7:
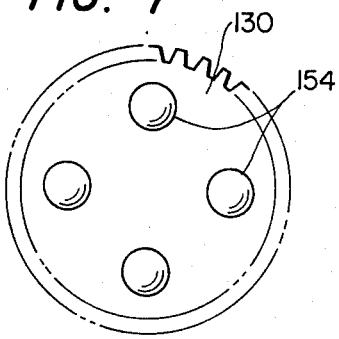
FIG. 7 is a side view showing round projections included in the clutch mechanism of FIGS. 4 and 5.

A clutch mechanism 138 includes the projections 154 and recesses 156 as shown in FIG. 6. The four projections 154 are positioned at equal intervals concentrically on one surface of the high torque gear 130. In the same manner, the eight recesses 156 are positioned at equal intervals concentrically on one surface of a synchronizing gear 152. It is preferable to provide the recesses so that the distances between adjacent recesses are smaller than the diameters of the round projections in order to provide smooth engagement between the recesses and projections. Thus, the projections 154 and recess 156 are engageable with each other. It is also preferable that the diameters of the projections 156 be somewhat smaller than those of the recesses. This is effective to provide a suitable displacement between the recesses and the projections in the engagement state to thereby provide smooth engagement between the slow speed gear 114 and the synchronizing gear 152 and between the slow speed gear 114 and the output gear 130.

The synchronizing gear 152 and the high torque gear can be simultaneously engaged with the slow gear 114 and are slidable in the axial direction. The synchronizing gear 152, the gears 128 and 130 and the cam sleeve 126 are biased to normally move rightwardly. The cam sleeve 126 has a slanted cam surface 127 while the fixed cam sleeve 124 has an associated cam surface 125.

In operation, when the vehicle is driven on a flat or downward grade surface, that is, when a low load is applied to the vehicle, the high speed gear 112 is rotated through the reduction gears (not shown) by the motor in engagement with the output gear 128 which is retained at the rightmost end while the cam surface 127 of the cam sleeve portion 126 is in full contact with the cam surface 125 of the fixed cam surface 124. Thus, the rotational torque of the motor is transmitted to the driven members, that is, the tires 120 in the same manner as in the prior art. However, in the transmission gear system according to the present invention, it should be noted that for high-speed torque operation the high speed gear 130 and the synchronizing gear 152 are rotated in the direction indicated by the arrow 144 at the same rotational speed and the two gears are not engaged with any other gears to thereby apply a smooth rotational torque to the output shaft 118 during high-speed low torque operation.

When low-speed high-torque is necessary for the vehicle due to the load applied to the wheels, the load applied to the wheels is transmitted to the output gear 128 through cam action between the surfaces 125 and 127. As a result, the output gear 128 is moved leftward against the spring 136 disengaging from the high speed gear 112. At this time, the synchronizing gear 152 is rotated synchronously with the slow gear 114 by assistance of the clutch mechanism 138 while the projections 154 are engaged with or disengaged from the recesses 156, the output gear 128 is completely disengaged from the high speed gear 112, and the rotation of the high torque gear 130 is simultaneously synchronized with the rotation of the slow gear 114. The synchronizing gear 152 serves to absorb the difference in circumferential rotational speeds between the high speed gear 112 and slow speed gear 114 to thereby completely eliminate shock caused in a changeover between high-speed low-torque and low-speed high-torque operations.

Thus, at low-speed high-load operation the slow speed gear 114 is directly engaged with the high torque gear 130 and hence the output gear 128 so that the torque is transmitted to the output shaft without action of the clutch mechanism. This advantageously simplifies the torque transmission during high-load operation.

Figure 8:
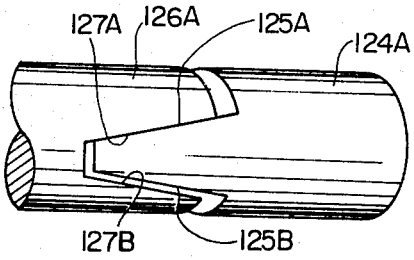
FIG. 8 is a perspective view showing another embodiment of the present invention.

FIG. 8 shows another embodiment of the present invention in which a modified fixed cam sleeve 124A is engaged with an associated axially movable cam sleeve 126A. The cam sleeve 124A has a forward direction slanted cam surface 125A and a reverse direction slanted cam surface 125B while the cam sleeve 126A has a forward direction slanted cam surface 127A and a reverse direction slanted cam surface 127B. The remainder of the structure is the same as that of the previous embodiment of the invention. The operation of the embodiment is substantially similar. The transmitted torque from the motor can be reversed by the high speed gear 112 in a manner well-known in the art. It is, therefore, possible to operate the vehicle in reverse. This is due to the fact that for high-speed low-torque operation the output gear 128 is engaged only with the high speed gear 112 while for low-speed high-torque operation the high torque gear 130 is engaged with the slanted gear 114.

The present invention has been described with reference to specific preferred embodiments thereof although the invention is not limited thereto.

What is claimed is:

1. In a motor driven toy, a transmission system comprising:

motor means;

a rotary output shaft;

driven means fixed on said rotary output shaft;

a first rotary driving member drivingly connected to said motor means having a first diameter and being disposed to be rotated at a predetermined position thereof;

a second rotary driving member having a second diameter smaller than said first diameter;

connecting means for connecting said first and second rotary driving members at the same rotational rate;

a first output member axially slidable on said output shaft and drivingly engageable exclusively with said first driving member;

a second output member axially slidable on said output shaft together with said first output member and being rotated with said first output member and drivingly engageable exclusively with said second driving member;

a first cam member axially slidable on said output shaft and rotated with said first output member including at least one further slanted cam surface;

a second cam member fixed on said output shaft, including at least one first slanted cam surface in contact with said first cam surface of said first cam member;

a synchronizing rotary member axially slidable on said output shaft for synchronizing said second output member with said second rotary driving member during changeover from high-speed low-torque operation to the low-speed high-torque operation, said synchronizing rotary member being biased toward said first and second output members; and two-way clutch means operatively disposed between said synchronizing rotary member and said second output member.

2. The transmission system as defined in claim 1 wherein said first cam member includes a second slanted surface and said second cam member includes a second slanted cam surface, each second slanted cam surface being inclined opposite to each said first slanted cam surface so that said first cam surfaces contact with each other for forward rotation of said output members and said second slant cam surfaces contact with each other for reverse rotation of said output members.

3. The transmission system as defined in claims 1 or 2 wherein said clutch means includes a plurality of round projections formed on said second output member and a plurality of associated round recesses formed on said synchronizing rotary member, said round projections being engageable with said round recesses.

4. The transmission system as defined in claims 1 or 2 wherein said clutch means includes a plurality of round recesses formed on said second output member and a plurality of associated round projections formed on said synchronizing rotary member, said round projections being engageable with said round recesses.

5. The transmission system as defined in claim 1 wherein said first and second rotary driving members each include a gear.

6. The transmission system as defined in claim 1 wherein said first and second output members each include a gear.

7. The transmission system as defined in claim 1 wherein diameters of said recesses are greater than those of said projections.

* * * * *